US008480859B2

(12) United States Patent
Kostrov et al.

(10) Patent No.: US 8,480,859 B2
(45) Date of Patent: Jul. 9, 2013

(54) METHOD AND APPARATUS FOR TREATMENT OF CRUDE OIL OR BITUMEN UNDER THE CONDITIONS OF AUTO-OSCILLATIONS

(76) Inventors: Sergey A Kostrov, Dallas, TX (US); Sergey V Bortkevitch, Plano, TX (US); Aleksey M Boldyrev, Plano, TX (US); William O Wooden, Plano, TX (US)

( * ) Notice: Subject to any disclaimer, the term of this patent is extended or adjusted under 35 U.S.C. 154(b) by 450 days.

(21) Appl. No.: 12/803,438

(22) Filed: Jun. 28, 2010

(65) Prior Publication Data

US 2011/0005973 A1 Jan. 13, 2011

Related U.S. Application Data

(60) Provisional application No. 61/270,678, filed on Jul. 13, 2009.

(51) Int. Cl.
*C01G 1/04* (2006.01)
*B01D 11/00* (2006.01)
*B06B 1/00* (2006.01)

(52) U.S. Cl.
USPC ..... 196/14.52; 422/127; 422/128; 208/390; 208/391

(58) Field of Classification Search
CPC ..... C10G 1/04
USPC ..... 196/14.52; 422/127, 128; 208/390, 208/391, 425; 366/108, 162.2
See application file for complete search history.

(56) References Cited

U.S. PATENT DOCUMENTS

| | | | | |
|---|---|---|---|---|
| 2,725,219 | A * | 11/1955 | Firth | 366/114 |
| 4,891,131 | A * | 1/1990 | Sadeghi et al. | 208/390 |
| 6,110,359 | A * | 8/2000 | Davis et al. | 208/390 |
| 7,428,896 | B2 * | 9/2008 | Eriksson et al. | 123/538 |
| 7,867,384 | B2 * | 1/2011 | Coveley | 208/390 |
| 8,192,615 | B2 * | 6/2012 | Donchenko et al. | 208/391 |

* cited by examiner

*Primary Examiner* — Nina Bhat

(57) ABSTRACT

An apparatus to decrease viscosity of crude oil or bitumen and increase the rate of fractional extraction by breaking the high molecular chains in crude oil or bitumen undergoing treatment which includes a flow of crude oil or bitumen inside the treatment unit under simultaneous affection by cavitations and vibrations on different frequencies and between at least two opposite conical jets formed inside the diffusers having the same axis of symmetry and interacting with each other under the conditions of an auto-oscillations of the periodic backward flows of fluid inside each conical jet due to a periodic negative pressure inside each conical jet and the periodic negative pressure is determined in accordance with the following formulae:

$$P_a = P_0 - \lambda \frac{\rho V^2}{2},$$

$$\text{wherein } V = \frac{f(D_4 - 2R)}{Sh},$$

$P_a$ is negative pressure in backward flow between the opposite conical jets.

13 Claims, 1 Drawing Sheet

METHOD AND APPARATUS FOR TREATMENT OF CRUDE OIL OR BITUMEN UNDER THE CONDITIONS OF AUTO-OSCILLATIONS

TECHNICAL FIELD

The present invention relates to the treatment of crude oil and bitumen. The process according to the invention finds applications notably to decrease viscosity of crude oil or bitumen and to increase the rate of fractional extraction by breaking the high molecular chains in crude oil or bitumen undergoing vibrations and cavitations treatment.

BACKGROUND OF INVENTION

A primary object of a first embodiment of the present invention is to provide an apparatus for treatment of crude oil or bitumen to decrease viscosity of crude oil or bitumen and increase the rate of fractional extraction.

BRIEF DESCRIPTION OF PRIOR ART

Many different techniques and apparatus are known in prior art for vibrational and cavitation treatment of crude oil and bitumen. For instance Russian Patent No. 2,221,633 and USSR patents No. 1,701,776; No. 1,706,097 and No. 1,762,293 describe a methods and apparatuses for vibrational and/or cavitational treatment of hydrocarbons and bitumen. All above mentioned methods and apparatuses have a one major disadvantage, i.e. the low intensity of vibrations and cavitation processes which in turn could not provide the effective breaking of high molecular chains in hydrocarbons undergoing treatment.

The present invention was developed to overcome drawbacks of prior methods and devices by providing an apparatus for treatment of crude oil and bitumen by highly intense vibrations and cavitation under conditions of an auto-oscillation regime.

SUMMARY OF INVENTION

Accordingly, a primary object of the present invention is to provide an apparatus for treatment of crude oil or bitumen which includes a treatment unit connected to the pump by its inlet and having at least one outlet and consisting of at least two opposite modules. Each module consists of a first wave generator having at least two inlets allowing the passage of the fluid into the first hollow chamber wherein an interaction of at least two fluid jets, directed towards each other that generate the cavitations and vibrations on the frequency $f_1$. The outlet of first wave generator is coupled with a jet impact device having an impact chamber interacting with the jet from outlet of the first generator followed by a second wave generator having a second hollow chamber and at least one tangential inlet forcing a fluid to be rotated inside second hollow chamber to provide a cavitation and vibrations on frequency $f_2$ followed by reverse vortex flow device inlet of which is connected with outlet of second hollow chamber and having a donut shaped chamber to provide a reverse vortex flow of fluid through the vortex flow device thereby generating cavitations and vibrations on frequency $f_3$. The internal diameter of a donut shaped chamber is smaller than diameter of inlet of vortex flow device. The outlet of the reverse flow vortex device has a diffuser allowing it to create a conical jet in such manner that at least two conical jets from each module flow against each other thereby interacting with each other and as a result generate an auto-oscillation process with periodic negative pressure occurring in the area between two conical jets causing a local backward flow between the two modules.

It is another object of the invention to provide an apparatus for treatment of crude oil or bitumen which includes a treatment unit, consisting of three or more opposite modules.

It is another object of the invention to provide an apparatus for treatment of crude oil or bitumen which includes a treatment unit wherein the first wave generator has a cylindrical first hollow chamber.

It is another object of the invention to provide an apparatus for treatment of crude oil or bitumen which includes a treatment unit wherein the first wave generator has at least two inlets having an equivalent diameter $d_1$ determined by the following formulae:

$$d_1 = \sqrt[4]{\frac{8n^2Q^2\rho k}{\pi^2\left(P - \frac{8\rho Q^2}{\pi^2 D_1^4}\right.}},$$

where n is number of inlets, Q is flow rate through the first wave generator, ρ is a density of fluid (crude oil or bitumen), k is a coefficient of fluid hydro-resistance in inlets, P is a pump pressure, $D_1$ is the diameter of the first hollow chamber, it equals 3.1415 and $$d_1 = \sqrt{\frac{4S_1}{\pi n}},$$

where $S_1$ is a total square area of inlets into the first wave generator.

It is another object of the invention to provide an apparatus for treatment of crude oil or bitumen which includes a treatment unit wherein the first wave generator has a spherical hollow chamber.

It is another object of the invention to provide an apparatus for treatment of crude oil or bitumen which includes a treatment unit wherein the jet impact device has a cylindrical impact chamber.

It is another object of the invention to provide an apparatus for treatment of crude oil or bitumen which includes a treatment unit wherein the jet impact device has a conical impact chamber with a conical angle β determined by the following formulae:

$$\beta = \arcsin\left(\gamma\frac{D_2^2 - d_2^2}{d_2^2}\right),$$

wherein $D_2$ is the smallest diameter of conical jet impact device, $d_2$ is diameter of first wave generator outlet and γ is an experimental coefficient γ=(0.2 to 0.7).

It is another object of the invention to provide an apparatus for treatment of crude oil or bitumen which includes a treatment unit wherein the jet impact device has a semi-spherical impact chamber.

It is another object of the invention to provide an apparatus for treatment of crude oil or bitumen wherein the second wave generator has a cylindrical second hollow chamber.

It is another object of the invention to provide an apparatus for treatment of crude oil or bitumen wherein the diameter $D_3$ of cylindrical second hollow chamber is determined by the following formulae:

$$D_3 = \frac{4ShQ}{\pi m d_3^2 f_2} + 2d_3,$$

wherein Sh is a Strouhal Number of flow, Q is flow rate through the second wave generator, π equals 3.1415, m is number of inlets into second wave generator, $f_2$ is frequency of vibrations generated by second wave generator, $d_3$ is an equivalent diameter of at least one tangential inlet into second wave generator, $$d_3 = \sqrt{\frac{4S_2}{\pi m}},$$

where $S_2$ is a total square area of tangential inlets into the second wave generator.

It is another object of the invention to provide an apparatus for treatment of crude oil or bitumen wherein the reverse vortex flow device has a diameter $D_4$ of center of symmetry of a donut shaped chamber of a reverse flow vortex device determined by the following formulae:

$$D_4 = \frac{ShQ}{2\pi\xi f_3 R^2} - R,$$

wherein Sh is a Strouhal Number of flow, Q is flow rate through the second wave generator, π equals 3.1415, ξ is an experimental coefficient of jet thickness reduction, ξ=(0.2 to 0.6) and R is the radius of a donut of the donut shaped chamber of the reverse vortex flow device.

It is another object of the invention to provide an apparatus for treatment of crude oil or bitumen wherein the reverse vortex flow device has a conical inlet into a donut shaped chamber.

It is another object of the invention to provide an apparatus for treatment of crude oil or bitumen which includes a treatment unit wherein each module has a diffuser with different angle compared with the angle of at least one other diffuser.

BRIEF DESCRIPTION OF THE DRAWINGS

Other objects and advantages of the invention will become apparent from the study of the following specification when viewed in light of the accompanying drawings, in which.

DETAILED DESCRIPTION AND OPERATION

Figure 1:
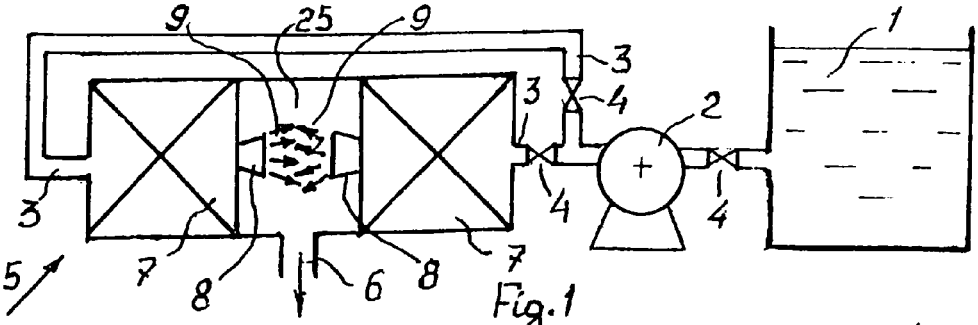
FIG. 1 is a scheme of equipment for treatment of crude oil or bitumen according to the invention.
Figure 2:
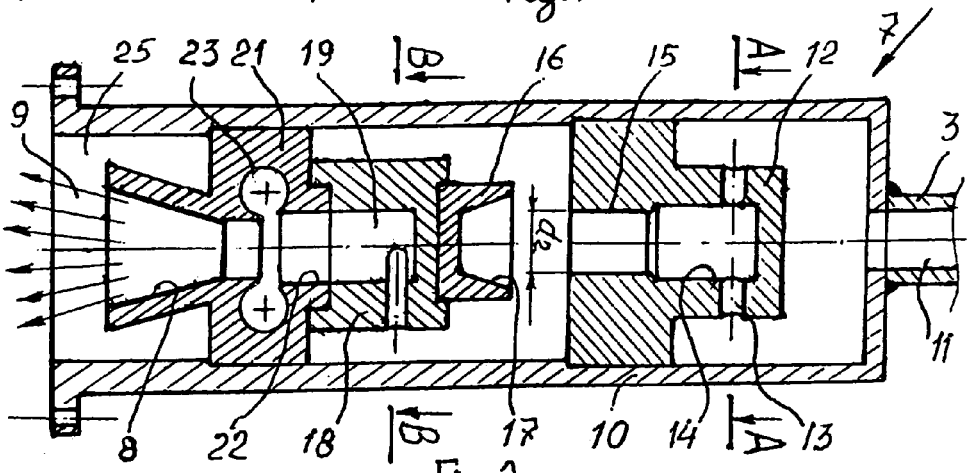
FIG. 2 is a cross-sectional side view of the module according to the invention.
Figure 2A:
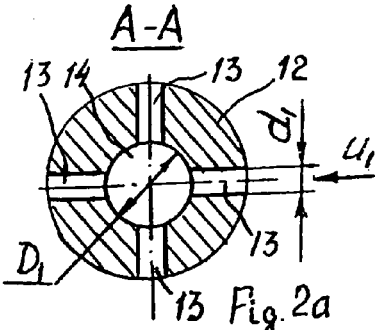
FIG. 2*a* is a cross-sectional view of the first wave generator according to the invention.
Figure 2B:
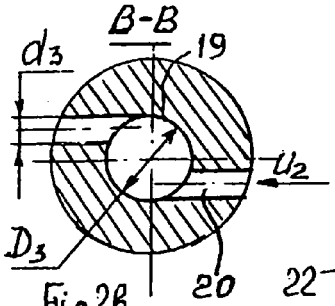
FIG. 2*b* is a cross-sectional view of the second wave generator according to the invention.
Figure 3:
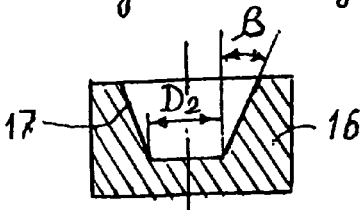
FIG. 3 is a cross-sectional side view of the jet impact device according to the invention.
Figure 4:
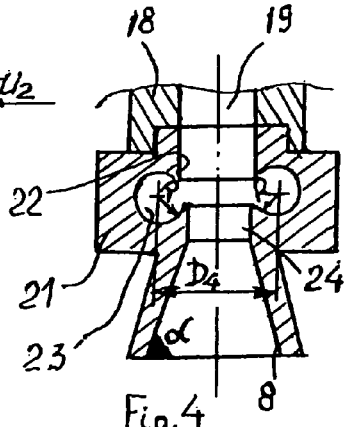
FIG. 4 is a cross-sectional side view of a reverse vortex flow device according to the invention.

Referring to FIG. 1, there is shown a scheme of treatment unit 5 to decrease viscosity of crude oil or bitumen and increase the rate of fractional extraction by breaking the high molecular chains in crude oil or bitumen undergoing treatment which includes a flow of crude oil or bitumen from the tank 1 via a pump 2 and pipes 3 into at least two modules 7 under simultaneous affection by cavitations and vibrations on different frequencies and between at least two opposite conical jets 9 formed inside each diffusers. Both diffusers have the same axis of symmetry and interacting with each other under the conditions of an auto-oscillations of the periodic backward flows of fluid inside each conical jet 9 due to the periodic negative pressure inside conical jets 9. The flow rate of fluid through each module 7 is controlled by valves 4.

Referring to FIG. 2, FIG. 2*a*, FIG. 2*b*, FIG. 3 and FIG. 4 there is shown a module 7 consisting of a first wave generator 12 having at least two inlets 13 allowing the passage of the fluid into the first hollow chamber 14 wherein an interaction of at least two fluid jets directed to each other with velocity $u_1$ generating cavitations and vibrations on the frequency $f_1$. At least two inlets have an equivalent diameter $d_1$ determined by the following formulae:

$$d_1 = \sqrt[4]{\frac{8n^2Q^2\rho k}{\pi^2(P - \frac{8\rho Q^2}{\pi^2 D_1^4}}},$$

where n is number of inlets 13, Q is flow rate through the first wave generator 12, ρ is a density of fluid (crude oil or bitumen), k is a coefficient of fluid hydro-resistance in inlets 13, P is a pump pressure, $D_1$ is the diameter of the first hollow chamber 14, π equals 3.1415 and $$d_1 = \sqrt{\frac{4S_1}{\pi n}},$$

where $S_1$ is a total square area of inlets 13 of first wave generator 12.

For example for cylindrical first hollow chamber 14 for the following parameters: n=4, $D_1$=0.01 m, P=4 MPa, k=0.3, ρ=980 kg/m$^3$ and Q=0.001 m$^3$/sec the equivalent diameter $d_1$ equals 0.0056 m.

The outlet 15 of first wave generator 12 is coupled with jet impact device 16 having an impact chamber 17 interacting with the jet from an outlet 15 of the first generator 12. As a result of such interaction the cavitations are formed inside the impact chamber 17. For conical impact chamber 17 of the jet impact device 16 the conical angle β is determined by the following formulae:

$$\beta = \arcsin\left(\gamma\frac{D_2^2 - d_2^2}{d_2^2}\right),$$

wherein $D_2$ is the smallest diameter of conical jet impact device 16, $d_2$ is diameter of first wave generator outlet 15 and γ is an experimental coefficient γ=(0.2 to 0.7). For example for $d_2$=0.008 m, $D_2$=0.01 m and γ=0.7 the conical angle β equals 26°.

The jet impact device 16 is followed by a second wave generator 18 having a second hollow chamber 19 and at least one tangential inlet 20 forcing a fluid to be rotated inside second hollow chamber 19 to provide a cavitations and vibrations on frequency $f_2$.

The diameter $D_3$ of cylindrical second hollow chamber 19 is determined by the following formulae:

$$D_3 = \frac{4ShQ}{\pi m d_3^2 f_2} + 2d_3,$$

wherein Sh is a Strouhal Number of flow, Q is flow rate through the second wave generator 18, π equals 3.1415, m is number of inlets into second wave generator 18, $f_2$ is frequency of vibrations generated by second wave generator 18, $d_3$ is an equivalent diameter of at least one tangential inlet 20 into second wave generator $$18,\ d_3 = \sqrt{\frac{4S_2}{\pi m}},$$

where $S_2$ is a total square area of tangential inlets into the second wave generator 18. For example for m=2, Q=0.001 $m^3$/sec, $f_2$=3000 Hz, $d_3$=0.004 m and Sh=0.38 the diameter $D_3$ of cylindrical second hollow chamber 19 equals 0.013 m. The second wave generator 18 is followed by reverse vortex flow device 21, the inlet 22 of which is connected with the outlet of second hollow chamber 19, and the reverse vortex flow device 21 has a donut shaped chamber 23 to provide a reverse vortex flow of fluid through the vortex flow device 21 thereby generating cavitations and vibrations on frequency $f_3$. The internal diameter 24 of a donut shaped chamber 23 is smaller than diameter of inlet 22 of vortex flow device 21 and the diameter $D_4$ of center of symmetry of a donut shaped chamber 23 of a reverse flow vortex device 21 is determined by the following formulae.

$$D_4 = \frac{ShQ}{2\pi\xi f_3 R^2} - R,$$

wherein Sh is a Strouhal Number of flow, Q is flow rate through the second wave generator 19, π equals 3.1415, ξ is an experimental coefficient of jet thickness reduction, ξ=(0.2 to 0.6) and R is the radius of a donut of the donut shaped chamber 23 of the reverse vortex flow device 21. For example for the following parameters: Q=0.001 $m^3$/sec, $f_3$=2000 Hz, R=0.002 m and Sh=0.38, ξ=0.3 diameter $D_4$ equals 0.023 m.

The outlet of the reverse flow vortex device 21 has a diffuser 8 allowing to create a conical jet 9 (FIG. 1) in such manner that at least two conical jets 9 from each module 7 flow against each other thereby interacting with each other and as a result generate an auto-oscillation process with periodic negative pressure occurring in the area between two conical jets 9 causing a local backward flow between the two modules 7. The periodic negative pressure inside at least two opposite conical jets 9 is determined in accordance with the following formulae:

$$P_a = P_0 - \lambda\frac{\rho V^2}{2},\quad \text{wherein } V = \frac{f(D_4 - 2R)}{Sh},$$

(see, for instance, G. N. Abramovich, "Theory of Turbulent Jets", Nauka, Moscow, 1984, p. 278.).

$P_a$ is negative pressure in backward flow between the opposite conical jets 9, $P_0$ is the atmospheric pressure, ρ is the density of crude oil or bitumen, V is velocity of fluid in conical jets 9, λ is an experimental coefficient of fluid hydro resistance (λ=0.3 to 07), f is a required frequency of auto-oscillations, $D_4$ is a diameter of center of symmetry of a donut shaped chamber 23 of a reverse flow vortex device 21, R is the radius of a donut of the donut shaped chamber 23 of the reverse flow vortex device 21 and Sh is a Strouhal Number of flow. For the following parameters: $P_0$=101325 Pa, f=1000 Hz, R=0.002 m, Sh=0.38, $D_4$=0.023 m and λ=0.5 the negative pressure in backward flow between the opposite conical jets 9 equals −53 kPa.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. An apparatus for treatment of crude oil or bitumen comprising a treatment unit connected to the pump by its inlet and having at least one outlet and consisting of at least two opposite modules each of which incorporates:

a) a first wave generator having an outlet and at least one inlet allowing the passage of the fluid into the first hollow chamber module wherein an interaction of at least two directed to each other fluid jets generates a cavitations and vibrations on the frequency $f_1$;

b) a jet impact device having an impact chamber interacting with the jet from the outlet of the first generator;

c) a second wave generator having an outlet and hydraulically connected with a flow of fluid from the impact device by at least one tangential inlet thereby forcing a fluid to be rotated inside the second hollow chamber module to provide a cavitations and vibrations on the frequency $f_2$;

d) a reverse vortex flow device having an outlet and an inlet connected to the outlet of the second hollow chamber and having a donut shaped chamber to provide a reverse vortex flow of fluid through the vortex device thereby generating a cavitations and vibrations on frequency $f_3$;

e) a diffuser connected to the outlet of the reverse flow vortex device allowing the creation of a conical jet in such manner that at least two conical jets from each module flow against each other thereby interacting with each other and as a result generating an auto-oscillation process with periodic negative pressure occurring in the area between two conical jets.

2. An apparatus as defined in claim 1, wherein a treatment unit consists of three or more opposite modules.

3. An apparatus as defined in claim 1, wherein the first wave generator has a cylindrical first hollow chamber.

4. An apparatus as defined in claim 2, wherein the first wave generator has at least two inlets having an equivalent diameter $d_1$ determined by the following formulae:

$$d_1 = \sqrt[4]{\frac{8n^2Q^2\rho k}{\pi^2(P - \frac{8\rho Q^2}{\pi^2 D_1^4}}},$$

where n is number of inlets, Q is flow rate through the first wave generator, ρ is a density of fluid (crude oil or bitumen), k is a coefficient of fluid hydro-resistance in inlets, P is a pump pressure, $D_1$ is the diameter of the first hollow chamber, π equals 3.1415 and $$d_1 = \sqrt{\frac{4S_1}{\pi n}},$$

where $S_1$ is a total square area of inlets into the first wave generator.

5. An apparatus as defined in claim 1, wherein the first wave generator has a spherical first hollow chamber.

6. An apparatus as defined in claim 1, wherein the jet impact device has a cylindrical impact chamber.

7. An apparatus as defined in claim 1, wherein the jet impact device has a semi-spherical impact chamber.

8. An apparatus as defined in claim 6, wherein the jet impact device has a conical impact chamber with a conical angle β determined by the following formulae:

$$\beta = \arcsin\left(\gamma \frac{D_2^2 - d_2^2}{d_2^2}\right),$$

wherein $D_2$ is the smallest diameter of conical jet impact device, $d_2$ is diameter of first wave generator outlet and γ is an experimental coefficient γ=(0.2 to 0.7).

9. An apparatus as defined in claim 1, wherein the second wave generator has a cylindrical second hollow chamber.

10. An apparatus as defined in claim 9, wherein the diameter $D_3$ of cylindrical second hollow chamber is determined by the following formulae:

$$D_3 = \frac{4ShQ}{\pi m d_3^2 f_2} + 2d_3,$$

wherein Sh is a Strouhal Number of flow, Q is flow rate through the second wave generator, π equals 3.1415, m is number of inlets into second wave generator, $f_2$ is frequency of vibrations generated by second wave generator, $d_3$ is an equivalent diameter of at least one inlet into second wave generator, $$d_3 = \sqrt{\frac{4S_2}{\pi m}},$$

where $S_2$ is a total square area of inlets into the second wave generator.

11. An apparatus as defined in claim 1, wherein the reverse vortex flow device has a diameter $D_4$ of center of symmetry of a donut shaped chamber of a reverse flow vortex device and is determined by the following formulae:

$$D_4 = \frac{ShQ}{2\pi\xi f_3 R^2} - R,$$

wherein Sh is a Strouhal Number of flow, Q is flow rate through the second wave generator, π equals 3.1415, ξ is an experimental coefficient of jet thickness reduction, ξ=(0.2 to 0.6) and R is the radius of a donut of the donut shaped chamber of the reverse vortex flow device.

12. An apparatus as defined in claim 11, wherein the reverse vortex flow device has a conical inlet into a donut shaped chamber.

13. An apparatus as defined in claim 1, wherein each module has a diffuser with different angle α compared with the angle of at least one other diffuser.

* * * * *